US007430948B2

(12) United States Patent
De Marco et al.

(10) Patent No.: US 7,430,948 B2
(45) Date of Patent: Oct. 7, 2008

(54) CUTTING EQUIPMENT FOR CONTINUOUS FORM

(75) Inventors: Giuliano De Marco, Ivrea (IT); Armando Aprato, Lugnacco (IT); Francesco Terrusi, Milan (IT); Alberto Massucco, Ivrea (IT)

(73) Assignee: Tecnau S.R.L. (IT)

( * ) Notice: Subject to any disclaimer, the term of this patent is extended or adjusted under 35 U.S.C. 154(b) by 428 days.

(21) Appl. No.: 10/848,059

(22) Filed: May 19, 2004

(65) Prior Publication Data

US 2004/0244550 A1 Dec. 9, 2004

(51) Int. Cl.
*B26D 5/20* (2006.01)
*B26D 5/28* (2006.01)
*B26D 5/40* (2006.01)

(52) U.S. Cl. ..... 83/236; 83/262; 83/423

(58) Field of Classification Search ..... 83/236, 83/262, 423; 226/27

See application file for complete search history.

(56) References Cited

U.S. PATENT DOCUMENTS 3,728,920 A * 4/1973 Gardner et al. ..... 83/106
3,796,117 A * 3/1974 Mukai et al. ..... 83/210
3,889,345 A * 6/1975 Hirschberg ..... 29/412
4,112,796 A 9/1978 Brechbuhl
4,611,799 A 9/1986 Nuttin
4,655,067 A * 4/1987 Frost et al. ..... 72/131
5,184,533 A * 2/1993 Golicz ..... 83/24
RE34,195 E * 3/1993 Santandrea et al. ..... 29/734
5,470,300 A * 11/1995 Terranova ..... 493/11
5,657,529 A 8/1997 Bohn et al.
5,768,959 A * 6/1998 Lorenzo ..... 83/74
5,810,235 A * 9/1998 Hoynant et al. ..... 226/1
5,813,586 A * 9/1998 Van den Steen et al. ..... 226/8
5,911,807 A * 6/1999 Brooks et al. ..... 83/262

(Continued)

FOREIGN PATENT DOCUMENTS

EP 0 491 570 A1 12/1991

(Continued)

OTHER PUBLICATIONS

"Control Principals" (Stevenson, John). Process/Industrial Instruments and Controls Handbook. 2.4. Mcgraw Hill 5th ed. 1999.*

(Continued)

*Primary Examiner*—Ken Peterson
*Assistant Examiner*—Sean Michalski
(74) *Attorney, Agent, or Firm*—Banner & Witcoff, Ltd.

(57) ABSTRACT

A cutting equipment (34) for continuous forms (37) comprising an input moving device (53) for a continuous form, a loop forming device (54), a cutting feeding device (56) and a transversal cutting mechanism (58) for the form. The form (37) has side sprocket holes (41) and the cutting feeding device (56) includes intermediate pin feed tractors (91, 92) interposed between the loop forming device (54) and the transversal cutting mechanism (58) and provided for cooperating with the sprocket holes of the section of form (37) to be cut. The loop forming device includes a loop sensor (78) and the input moving device (53) causes the form to be entered at a mean velocity depending on the velocity of the intermediate pin feed tractors (91, 92) and on the state of the loop sensor.

12 Claims, 9 Drawing Sheets

U.S. PATENT DOCUMENTS

| | | | | |
|---|---|---|---|---|
| 6,062,120 | A * | 5/2000 | Tsuzaki et al. | 83/76.1 |
| 6,336,406 | B1 * | 1/2002 | Wakabayashi et al. | 101/483 |
| 6,418,825 | B1 * | 7/2002 | Hartmann | 83/110 |
| 6,598,529 | B2 * | 7/2003 | Muller | 101/484 |
| 2003/0089209 | A1 | 5/2003 | Brueckel et al. | |
| 2004/0221700 | A1 * | 11/2004 | Williams et al. | 83/236 |
| 2005/0126358 | A1 * | 6/2005 | Yamamoto | 83/39 |
| 2006/0230968 | A1 * | 10/2006 | Brandenburg et al. | 101/485 |

FOREIGN PATENT DOCUMENTS

| | | | |
|---|---|---|---|
| EP | 1 044 915 | B1 | 4/2004 |

OTHER PUBLICATIONS

Sclater, N (Mechanisms & Mechanical Devices Sourcebook (3rd) McGraw-Hill 2001). pp. 340, 352-354.*

Manley, D. (2000) Technology of Biscuits, Crackers and Cookies (3rd Edition). Woodhead Publishing pp. 364.*

Process/Industrial Instruments and Controls Handbook, Title and pp. 5.92-5.110. McMillan, Gregory (editor). Mcgraw Hill 5th ed. 1999.*

Undergraduate Core Course Descriptions. Three pages. Printed from www.enme.umd.edu/undergrad/courses/core.html. on Mar. 15, 2007.*

Process/Industrial Instruments and Controls Handbook. pp. 2.44-2.46. McMillan, gregory (editor). McGraw Hill 5th ed. 1999.*

Partial European Search Report, dated Jan. 10, 2004.

* cited by examiner

CUTTING EQUIPMENT FOR CONTINUOUS FORM

FIELD OF THE INVENTION

The present invention relates to a cutting equipment for continuous forms. More specifically, the invention relates to a transversal cutting equipment for continuous forms comprising an input moving device, a loop forming device, a cutting feeding device and a transversal cutting mechanism for the form.

BACKGROUND OF THE INVENTION

Cutting equipments of this type are generally used in complex systems for the automatic processing of documents comprising high speed printers and unwinding devices which operate on continuous forms of paper webs. These equipments provide to separate the continuous form into singular or discrete printed documents for the following processing.

For the production of standard documents the times necessary for the cutting of the forms, the separation of the sheets, the finish and the collection of the documents are well longer with respect to the times associated to the print.

In fact, the high speed printers can work in continuous. Instead, the cutting equipments and the finishing apparatuses must be periodically stopped for allowing the manual removal and collection of the documents.

A buffer store for the printed and not yet cut form can be provided between the high speed printer and the cutting equipment. Despite it and in dependence on the interruptions, the general productivity of the system results limited by the times of cutting.

Typically, a cutting equipment for continuous forms includes an input moving device and a cutting mechanism with a transversal blade. The moving device introduces the form at a velocity which, in average and in the case of on-line connection, must be equal to the delivery velocity of the printer.

The velocity of the forms can be sufficiently high in cutting equipments having helicoidal rotating blades with cutting on the fly and the use of these equipments in the systems of automatic processing of documents is not penalizing. Nevertheless these equipments result particularly expensive in the purchase and in the maintenance.

In the equipments in which the blade is operated in intermittent way the form must be stopped and, upstream of the cutting mechanism, a feeding device is provided for stopping the form before the cutting and accelerating it immediately after the cutting. A loop forming device, interposed between the moving device and the feeding device, allows the section of form to be cut to be moved according to a law of motion different from the law of motion of the entering form.

The velocity of cutting depends on the times required for the stop and the start of the section of form to be cut, for the stabilization of the loop and for the execution of the cut. These times are naturally conditioned by the variability of response of the involved mechanisms, by the transmission of the control of movement to the form and by the interaction of the mechanisms with the characteristics of the form. The velocity is also influenced by the times of contact of the form with the moving blade.

The involved parameters impose that, for an acceptable reliability of a cutting equipment, the stroke of the blade should be rather extended. Further, sufficient delay times should be provided between the stop of the feeding device and the start of the cutting mechanism and, respectively, between the end of the cutting and the start of the feeding device.

The cutting equipments which operate while the form is at rest are much less expensive than the cutting equipments operating on the fly but, still today, the obtainable cutting velocity represents a limit to the productivity of the automatic processing of documents using these equipments.

A cutting equipment with reciprocating blade, in which the paper web is introduced at constant velocity and providing a loop forming device is known. The cutting feeding device includes a clamping device for intermittent clamping the web, a conveyor with a continuously driven transport roller, a pressure roller with a high coefficient of friction and a lifting device controlling the pressure roller for accelerating and braking the section of form to be cut. For this equipment and form length of 30 cm (12"), a cutting performance of up to 36.000 cuts per hour is hypothesized.

Despite these expectations, the cutting equipments commercially available have a production of around 25.000 single sheets per hour and form of 12". Such value is well less of what is desirable, particularly when the cuts are performed, out of the line of the printers, on pre-printed forms, wound in rolls or folded up in stacks. In particular, also the above known equipment has problems in transmitting the start and stop commands to the section of form to be cut.

Another problem of the cutting equipments operating while the form is at rest arises from the fact that the formation of the loops is a source of notable noise and instability with risks of tears in the web and errors in the cuts.

A cutting equipment in which the loop develops upwardly with respect to the movement surface of the web for the action of an air jet is also known. A control means controls both the input moving device and the cutting feeding device to stop the input moving device when the loop reaches a predetermined maximum height, starts thereafter the cutting feeding device and, in sequence, starts the input moving device.

Also in this device the length of the entering form and the length of the loop section are subjected to accelerations and brakes with tensions on the incoming form, risks of slippage and limitations on the obtainable cutting speed.

SUMMARY OF THE INVENTION

The principal object of the present invention is to accomplish a cutting equipment for continuous forms that ensures a high productivity and which results reliable, noiseless and of limited cost.

In such context, a technical problem of the invention is to achieve a cutting equipment and a method of cutting for continuous forms having side sprocket holes which allow a true response of the form to the acceleration and brake controls of the cutting feeding device.

According to a first feature, the cutting feeding device of the cutting equipment includes intermediate pin feed tractors interposed between the loop forming device and the transversal cutting mechanism and provided for cooperating with the sprocket holes of the section of form to be cut.

Another object of the invention is to achieve a cutting equipments of high reliability and of low time of adherence of the cut portion of the form with the moving blade.

The cutting equipment comprises a transversal cutting mechanism including a blade provided for a reciprocating motion and having a body with at least a cutting edge and a surface adjacent to said edge. The blade defines in said body a series of conduction ducts for the passage of the air having a corresponding series of openings along said surface adjacent to a cutting edge and wherein said conduction ducts connect said openings with the atmosphere for levelling, during the cut, the pressure on the surface adjacent to the cutting edge at the atmosphere value.

Still another object of the invention it is to realize a cutting equipment for continuous forms that allows easy maintenance operations of the cutting mechanism.

The cutting equipment can use different cutting mechanisms for the forms. Each cutting mechanism has a blade with at least one cutting edge and susceptible of reciprocating motion and at least one counter-blade with which the at least one cutting edge can cooperate for the cutting of the form. The cutting mechanism comprises a support module including a pair of guide crossbars for guiding the blade and at least one support crossbar for supporting the at least one counter-blade and wherein the blade has side stripes coplanar with said at least one cutting edge and which extend at the sides of said at least one cutting edge. The pair of guide crossbars and said at least one support crossbar are realized in light alloy. The at least one counter-blade is mounted on said at least one support crossbar coplanar with the side stripes of the blade and said support module is mounted on a frame with possibility of manual removal.

According to another feature, the cutting equipment comprises a cutting mechanism supported by a corresponding module for being interchanged with modules of different features and each module supports coding elements with information indicative of the cutting specifications of the supported cutting mechanism. A recognizing device is provided for recognizing the information of the coding elements and causing an automatic cutting operation according to said cutting specifications.

A further object of the invention is to accomplish an intermittent motion transversal cutting equipment of high reliability, in which the form is introduced at substantially constant velocity and in which the loop section upstream of the cutting feeding device results stable and of limited dimensions.

In accomplishing this and other objects there is provided a cutting equipment for continuous forms including an input moving device, a loop forming device, a cutting feeding device and a transversal cutting mechanism and means for setting data of the form to be cut, said equipment further comprising: an input servomechanism for said input moving device including an input position encoder for the entering of said form; a loop forming device including at least a loop sensor; a feeding servomechanism of the cutting feeding device including an intermediate position encoder, said feeding servomechanism moving the section of form to be cut in response to said setting data and to signals of said intermediate position encoder; and a cutting servomechanism of the transversal cutting mechanism including a cutting position encoder. Said cutting servomechanism is servoized to said cutting position encoder and the servomechanism of said cutting mechanism is servoized to said intermediate position encoder; said input servo-mechanism being servoized to said feeding encoder and to said at least one loop sensor for minimizing the variation of the velocity of the entering form.

The characteristics of the invention will become clear from the following detailed description of a preferred embodiment, provided merely by way of non restrictive example, with the aid of the accompanying drawings, wherein:

DESCRIPTION OF THE PREFERRED EMBODIMENTS

Figure 1:
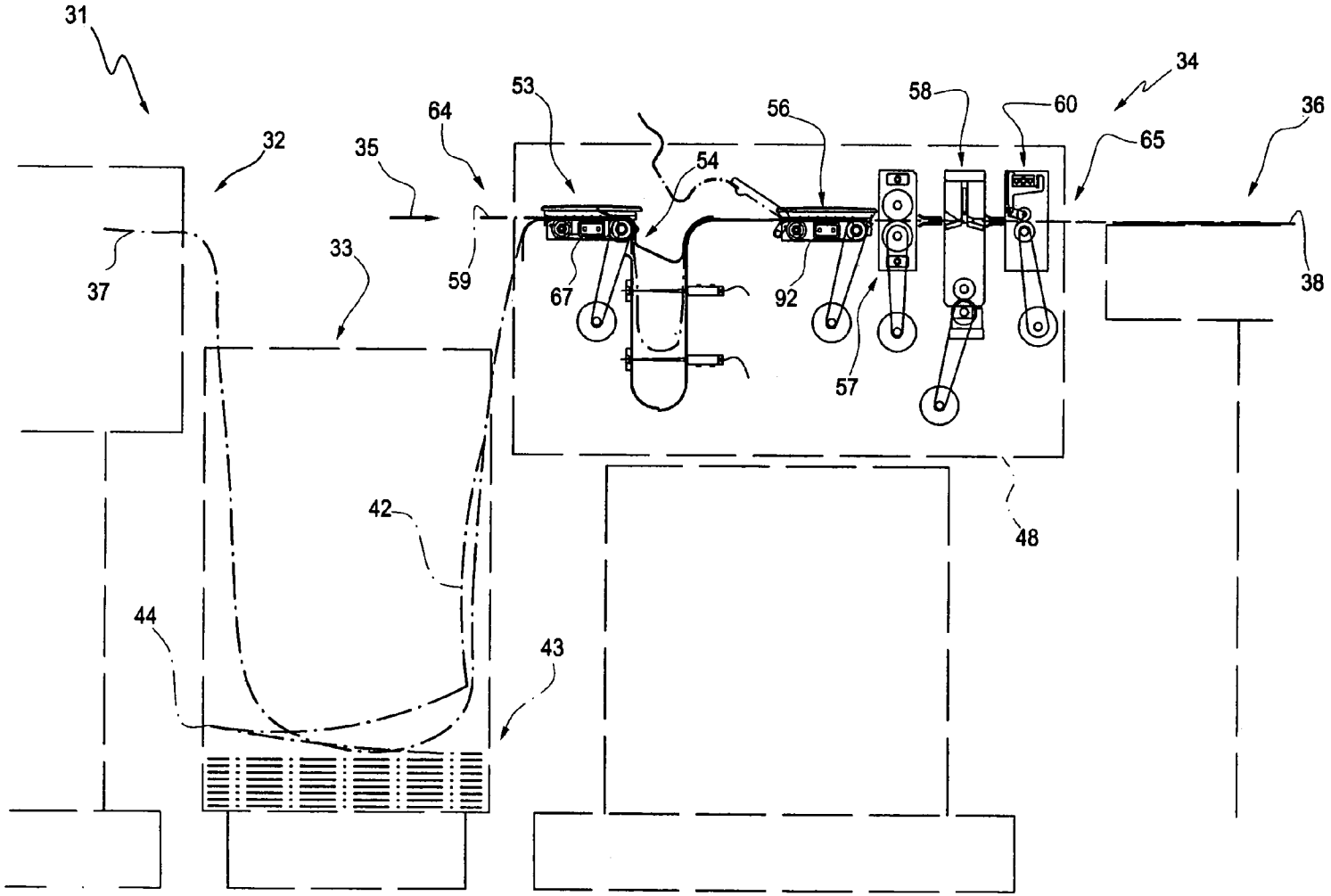
FIG. 1 represents a schematic view of a system for the automatic processing of documents comprising a cutting equipment for continuous forms according to the invention.

Represented with 31 in FIG. 1 is a system for the automatic processing of documents comprising a high speed printer 32, a buffer store 33, a cutting equipment 34 and, for instance, a sequencer 36.

The system 31 uses a continuous form 37 defined in a respective paper web and the cutting equipment 34 is provided to move the web along a direction of movement 35 and separate single sheets 38 from the form 37.

Figure 8:
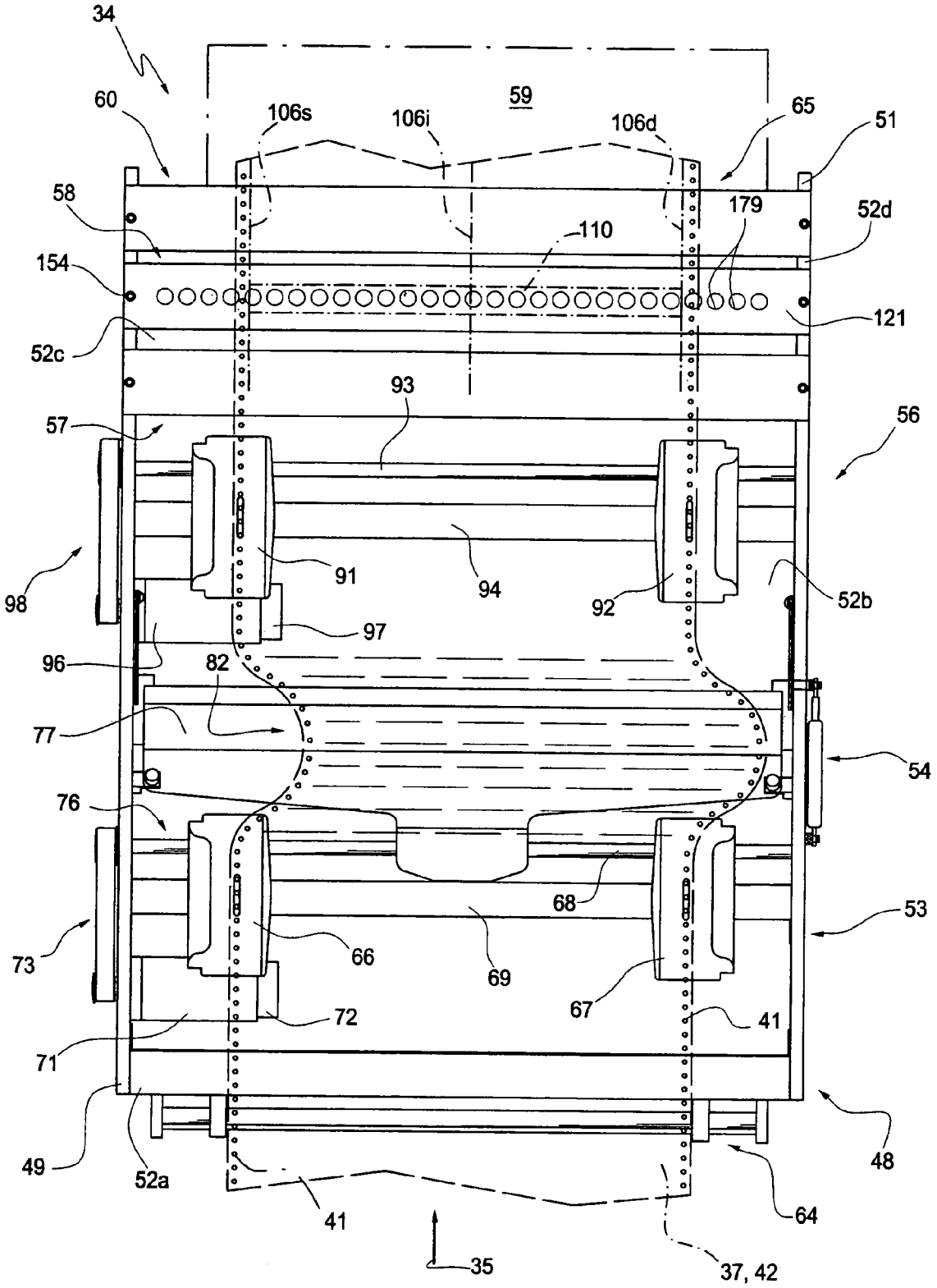
FIG. 8 represents a schematic plan view of the cutting equipment of the invention.

As far as the present invention it concerns, the continuous form 37 has side sprocket holes 41 (see FIG. 8) and the printer 32 (FIG. 1) is of known type, for instance a laser printer, and provides to print the information regarding the sheets 38 on the form 37. The buffer store 33 can receive long loops of the printed and unprinted form 37 supplied by the equipment 34 and the sequencer 36 is pre-set to arrange, in sequence, the sheets 38.

The cutting equipment 34 can be used in association with other finishing apparatuses, for instance devices for forming booklets and inserter devices for documents and, out-line from the printing equipment, for receiving a form from an unwinding device not shown in the drawings.

In the case of off-line use, the form, represented with 42, can be drawn out from a stack 43 in which the form is fan folded along transversal lines of weakening 44.

Figure 2:
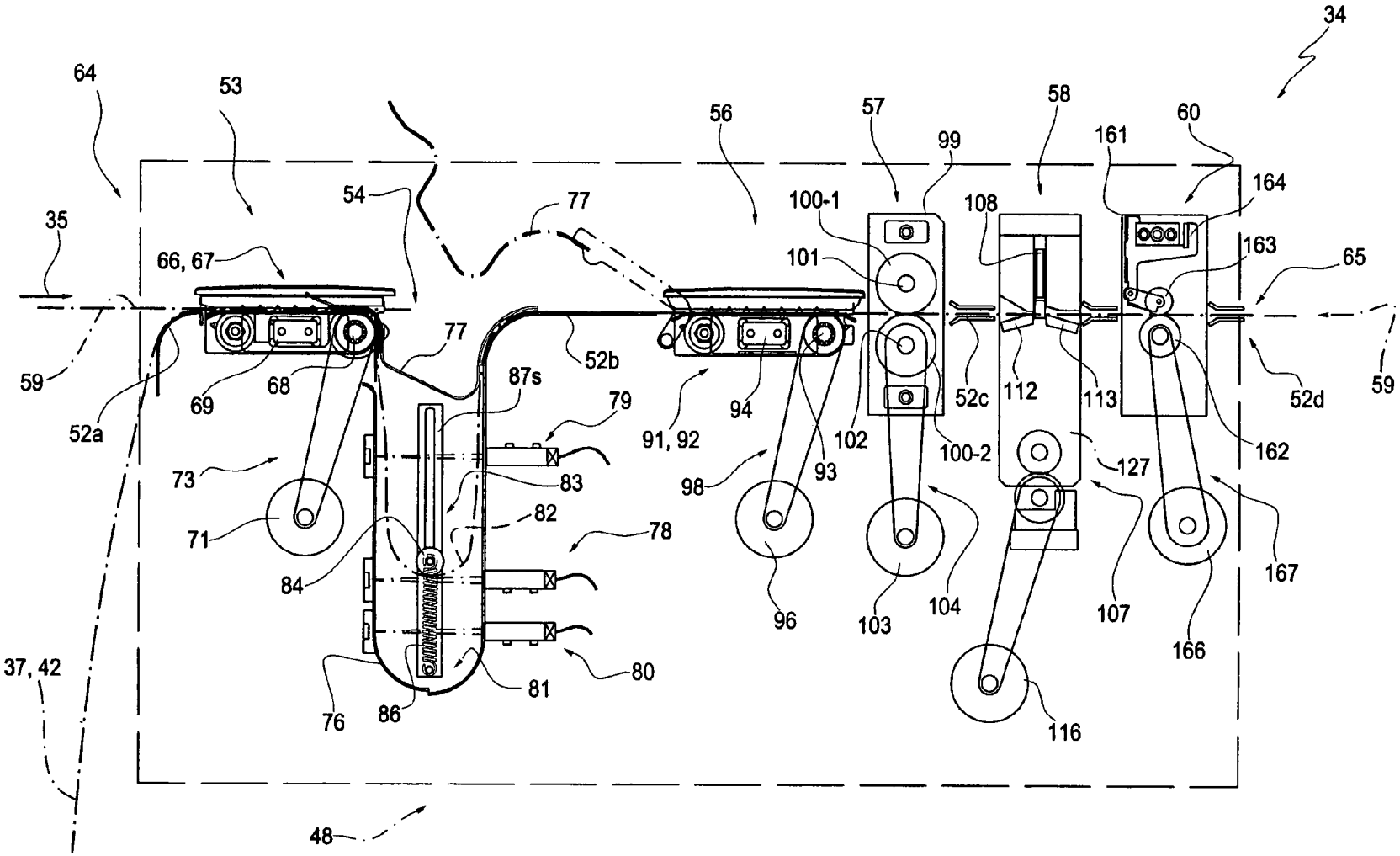
FIG. 2 shows a schematic sectioned side view of the cutting equipment according to the invention.

The equipment 34 (FIGS. 2 and 8) comprises a frame 48 with two sides 49 and 51 and elements of support and guide 52*a*, 52*b*, 52*c* and 52*d* for the form 37 or 42.

For the advancing and the control of the form 37 or 42 along the direction 35, the equipment 34 includes an input moving device 53 for the incoming section of the form, a loop forming device 54 and a cutting feeding device 56 for feeding the section of form to be cut.

A trimming mechanism 57 provides to execute longitudinal cuts of the form 37, 42 and a transversal cutting mechanism 58 provides to execute the transversal cuts of the form, while an extraction device 60 extracts the cut sheets 38 from the mechanism 58.

The equipment 34 further includes a control and power system for the various electromechanic components comprising a microprocessor 55 (FIG. 13) with a basic program, an electronic control module 61, a power supply group 62 and a control console 63.

The elements 52*a*-52*d* (FIGS. 2 and 8) are adapted to support and guide the form 37 or 42 along a substantially horizontal movement surface 59 between an input area 64 and an output area 65. The elements 52*a* and 52*d* are adjacent to the input area 64 and, respectively, to the output area 65 and are interposed between the loop forming device 54 and the feeding device 56 and between the device 56 and the trimming mechanism 57, respectively.

The moving device 53 includes two input pin feed tractors 66, 67, a motor axis 68 and a guide and support axis 69 for the tractors 66, 67 and an input actuating motor 71. A position encoder 72 is coupled to the shaft of the motor 71 and a transmission assembly 73 with pulleys and a toothed belt interconnects the motor axis 68 with the shaft of the motor 71. The axes 68, 69 are mounted between the sides 49 and 51 of the frame 48 and the motor 71 is mounted on the side 49.

The input tractors 66, 67 are of the type including an endless and sprocket belt and pulleys having possibility of transversal regulation along the guide and support axis 69. The sprocket belts of the tractors 66, 67 are provided to cooperate with the sprocket holes 41 of the form 37 emerging from the buffer store 33 or with the sprocket holes of the form 42 unwinding from the stack 43. As an example, the motor 71 is of brushless D.C. type and the encoder 72 supplies pulses St1 (FIG. 13) in response to given angular steps of the shaft of the motor 71.

The motor axis 68 (FIGS. 2 and 8) connects in the rotation the motor pulleys of the two tractors 66, 67 and the motor 71 is adapted to put in rotation the axis 68 through the pulleys and the belt of the transmission assembly 73, for a relative movement of the sprocket belt along the movement surface 59, in a way known per sé.

The loop forming device 54 includes a laminar structure 76 of U shaped section and a paper-guide member 77. Two photoelectric pairs 78 and 79 are associated, as loop sensors, to the forming device 54. For instance, each photoelectric pair comprises a LED photo emitter and a photo receiver arranged, one in front of the other, between the arms of the structure 76.

The laminar structure 76 is vertically mounted transversal to the sides 49 and 51 of the frame 48 and includes an input edge adjacent to the input tractors 66, 67 and an output edge adjacent to the element of support and guide 52*b* and defines a vane 81 for a loop section 82 of the form 37 or 42 below the movement surface 59.

The paper-guide member 77 is fulcrumed adjacent to an end of the guide of support element 52*b* and includes a terminal portion, an intermediate portion and a fulcrum portion. The terminal portion and the fulcrum portion of the member 77 are adapted to hold the form 37 adjacent to the input tractors 66, 67 and the element 52*c*, respectively, and the intermediate portion is arranged inside the vane 81 above the loop section 82.

The photoelectric pair 78 is arranged at an intermediate section of the vane 81 and operates as reference loop sensor for recognizing form loops interposed between the photo emitter and the photo receiver and having a length greater than a predetermined reference value. The photoelectric pair 79 is arranged at an upper portion of the vane 81 and operates as minimum loop sensor for revealing form loops of length less than a predetermined minimum value.

A third photoelectric pair 80 is arranged in a lower section of the vane 81 below the photoelectric pair 78 and operates, as maximum loop sensor, to recognize anomalous loops of dimensions such to completely fill the vane 81.

Mainly for the case in which the equipment 34 is used for cutting fan folded forms 42 from the stack 43, a loop stabilizing device 83 can be provided. For example, this device includes a roller 84 and a pair of coil springs 86.

The roller 84 extends through the whole width of the form 37 or 42 and includes end sections which can slide in respective vertical guides 87*s* and 87*d* supported by the arms of the structure 76. Due to its weight and the action of the springs 86, the roller 84 cooperates with the bottom of the loop and maintains constantly taut, under dynamic conditions, the loop section 82.

In alternative, the loop stabilizing device 83 can include an aspirator at the bottom of the vane 81 for providing an action of aspiration on the lower portion of the loop section 82.

According to the invention, the cutting feeding device 56 includes two intermediate tractors 91, 92, a motor axis 93 and a guide and support axis 94 for the tractors 91, 92 and a feeding actuating motor 96. A position encoder 97 is coupled to the shaft of the motor 96 and a transmission assembly 98 with pulleys and a toothed belt interconnects the axis 93 and the shaft of the motor 96. Also the motor 96 can be of brushless D.C. type and the encoder 97 supplies pulses St2 (FIG. 13) in response to given angular steps of the shaft of the motor 96.

The intermediate tractors 91, 92 (FIGS. 2 and 8) are each one of the type including an endless sprocket belt and pulleys identical to the input tractors 66, 67 and are mounted between the sides 49 and 51 of the frame 48. The tractors 91, 92 have possibility of transversal regulation along the guide and support axis 94 and the sprocket belts are provided to cooperate with the sprocket holes 41 of the section of form 37 or 42 emerging from the loop forming device 54.

The motor axis 93 connects in the rotation the motor pulleys of the two tractors 91, 92 and the motor 96 is adapted to put in rotation the axis 93 through the pulleys and the belt of the transmission assembly 98, in a manner known per sé.

The trimming mechanism 57 includes a support module 99, two or more pairs of rotating disks 100-1 and 100-2, a motor 103 and a transmission assembly 104. The disks 100-1 and 100-2 are mounted on axes 101 and 102, and the transmission assembly 104 is interposed between the axis 102 and the motor 103. The axes 101 and 102, are kinematically interconnected each the other and the disks 100-1 and 100-2 are arranged above and below the movement surface 59, in slight interference with the movement surface 59, in a manner known per sé.

The support module 99 is mounted with possibility of manual removal on notches of the sides 49 and 51. The disks 100-1 and 100-2 are adapted to perform side longitudinal cuts 106*s* and 106*d* adjacent to the sprocket holes 41 for the trimming of the form 37 or 42 and, optionally, for executing an intermediate longitudinal cut 106*i* or more longitudinal cuts in the form 37 or 42 to split the paper web and define two or more longitudinal portions.

Figure 3:
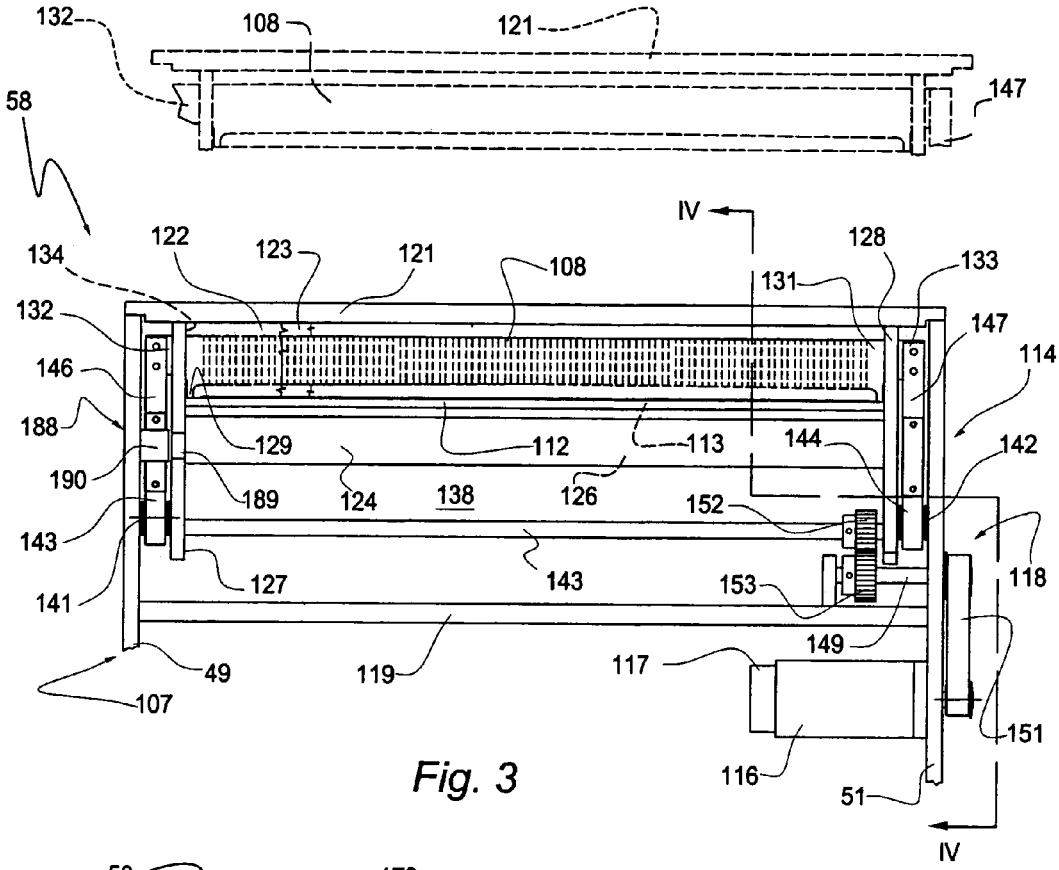
FIG. 3 represents a schematic front view of a functional group of the cutting equipment of FIG. 2.
Figure 4:
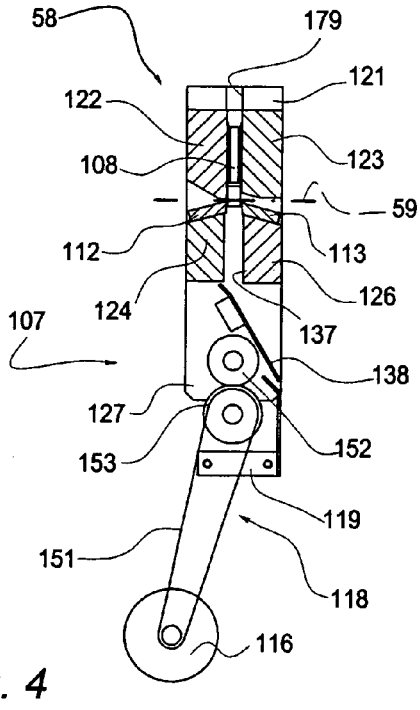
FIG. 4 shows a schematic partial section of the functional group of FIG. 3 according to line IV-IV.

In the embodiment of the invention which follows, the transversal cutting mechanism 58 (FIGS. 2, 3 and 8) is adapted to separate from the fan folded forms 42 a strip 110 with two transversal cuts, upstream and downstream from each line of weakening 44 of the stack 43. However a mechanism for a single transversal cut can be provided without departing from the scope of the invention.

The transversal cutting mechanism 58 includes a support module 107, a guillotine like blade 108 with two cutting edges, two counter-blades 112 and 113 upstream and downstream along the direction of movement 35 of the form, a control assembly 114 and a cutting actuating motor 116. A position encoder 117 is coupled to the shaft of the motor 116 and a transmission assembly 118 interconnects the control assembly 114 and the shaft of the motor 116. The motor 96 can be of brushless D.C. type and the encoder 97 supplies pulses St3 (FIG. 13) for given angular steps of the shaft of the motor 116.

The module 107 (FIGS. 3,4, 6 and 8) supports the blade 108, the counter-blades 112 and 113 and the control assembly 114. The module 107 is mounted, with possibility of manual removal, between the sides 49 and 51 adjacent to a crossbar 119, and the motor 116 is mounted on the side 51 of the frame 48.

In detail, the support module 107 includes an upper crossbar 121, two guide crossbars 122 and 123 for the blade 108, two contrast crossbars 124 and 126 for the counter-blades 112 and 113 and two small sides 127 and 128. The small sides 127 and 128 firmly connect the guide crossbars 122 and 123 with the contrast crossbars 124 and 126 and the upper crossbar 121 is firmly connected with the small sides 127 and 128 and the crossbars 121 and 122.

Figure 5:
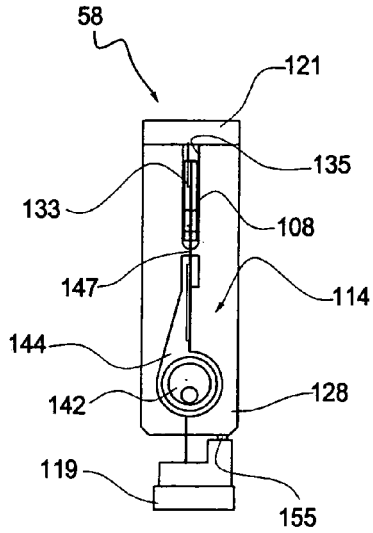
FIG. 5 represents a sectioned side view of some details of the functional group of FIG. 3.
Figure 6:
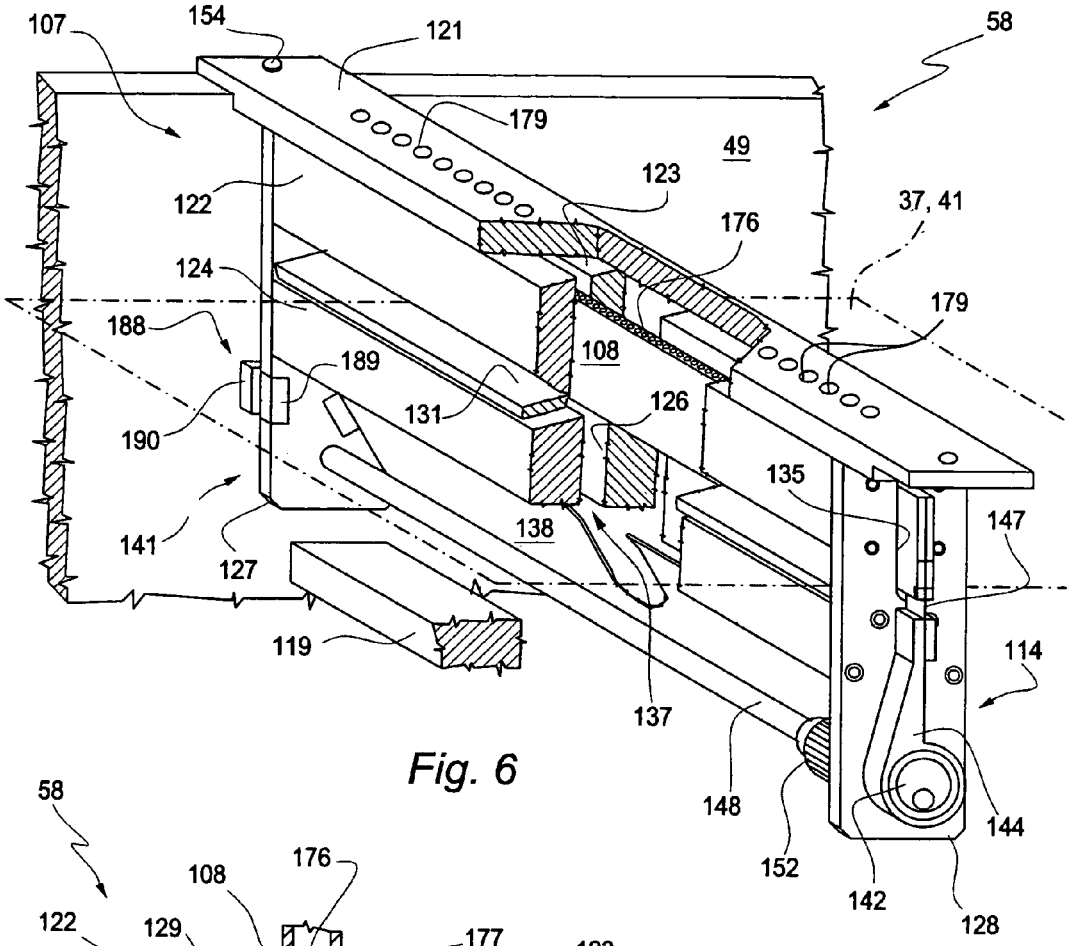
FIG. 6 represents a schematic sectioned perspective view of the group of FIG. 3.
Figure 9:
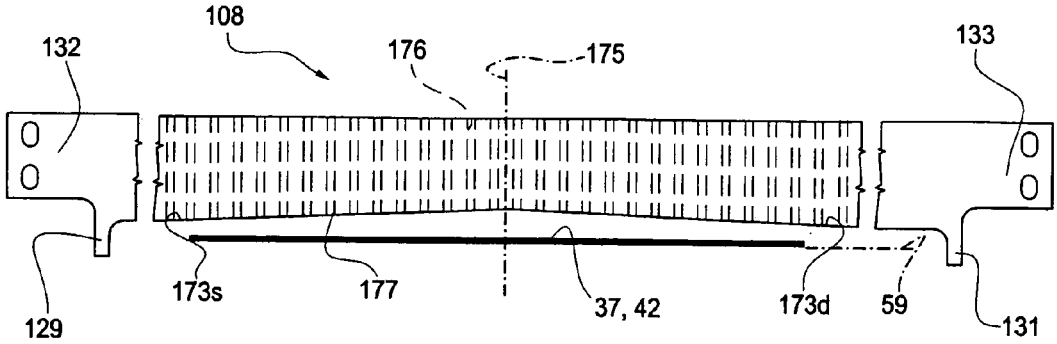
FIG. 9 shows a schematic front view of a component of the functional group of FIG. 3.
Figure 10:
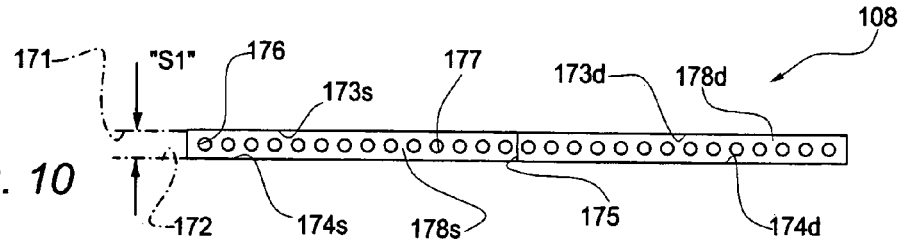
FIG. 10 represents a plan view of the component of FIG. 9.

The blade 108 (see also FIGS. 9 and 10) extends transversally between the small sides 127 and 128, has constant thickness "S1" and is exactly guided on its upper part by the crossbars 122 and 123. At its sides, the blade 108 provides two guide stripes 129 and 131 and two control lugs 132 and 133. The guide stripes 129 and 131 extend downwardly beyond the cutting edges more than the overall stroke of the blade. The control lugs 132 and 133 cross two respective vertical slits 134 and 135 of the small sides 127 and 128 (FIGS. 3, 5 and 6) and project in the spaces between the small sides 127 and 128 and the sides 49 and 51 of the frame 48.

The counter-blades 112 and 113 are supported by the contrast crossbars 124 and 126: the cutting edge of the upstream counter-blade 112 (FIG. 7) is coplanar with the movement surface 59, while the cutting edge of the downstream counter-blade 113 is a little below the surface 59. The counter-blades cooperate with the guide stripes 129 and 131 and the respective cutting edges are suitable for cooperating with the two cutting edges of the blade 108 and cutting strips 110 of width equal to the thickness "S1" of the blade.

The contrast crossbars 124 and 126 define a vane 137 below the counter-blades 112 and 113 for an easy fall of the strips 110 separated by the blade 108 and successively deviated by a plate 138.

The control assembly 114 (FIGS. 3, 5 and 6) includes two eccentric cams 141 and 142, two corresponding connecting rods 143 and 144 and two flexible connecting strips 146 and 147.

The eccentric cams 141 and 142 are arranged in the space between the small side 127 and the side 49 and, respectively, in the space between the small side 128 and the side 51 of the frame 48 and are connected in the rotation by an axis 148 rotatable transversal to the small sides 127 and 128.

The connecting rods 143 and 144 are coupled with the eccentric cams 141 and 142 and are connected through the flexible strips 146 and 147 with the lugs 132 and 133 of the blade 108 projecting from the slits 134 and 135. It defines a structure of high dynamic rigidity. The cyclical rotation of the eccentric cams 141 and 142 causes a reciprocating movement, guillotine like, of the blade 108, in interference with the movement surface 59, for full width cuttings of the continuous form 37 or 42 and the separation of the strips 110.

The transmission assembly 118 includes an intermediate shaft 149, a toothed pulleys and belt group 151 and a pair of toothed wheels 152 and 153. The shaft 149 is supported in the rotation by the side 51 of the frame 48 adjacent to the crossbar 119. The toothed wheels 152 and 153 are keyed on the axis 148 and on the shaft 149, respectively, and the shaft 149 is connected with the motor 116 through the pulleys-belt group 151.

The support module 107 is mounted on the frame 48, for example, through locking screws 154 between the ends of the crossbar 121 and the higher edges of the sides 49 and 51 and through alignment pins 155 on the crossbar 119. With the locking of the screws 154, the toothed wheel 152 of the axis 148 will be coupled with the toothed wheel 153 of the shaft 149 and the movement surface 59 will be tangent to the cutting edge of the counter-blade 112.

For the removal, it is sufficient to loosen the screws 154 and lift the module 107 from the frame 48, with separation of the pins 155 and uncoupling of the toothed wheels 152 and 153.

According to another aspect of the invention, the weight of the support module 107 is particularly low (less than 18 kg) for enabling its removal by a single person without other assistance. To this end, the upper crossbar 121, the guide crossbars 122 and 123 and the contrast crossbars 124 and 125 are of light material, for instance an aluminum alloy.

Suitably, the counter-blades 112 and 113, in tempered steel, are mounted, for instance by means of screws, on the crossbars 124 and 125 with possibility of removal for the sharpening and the regulation and such that the cutting edges are coplanar with the guide stripes 129 and 131.

Figure 7:
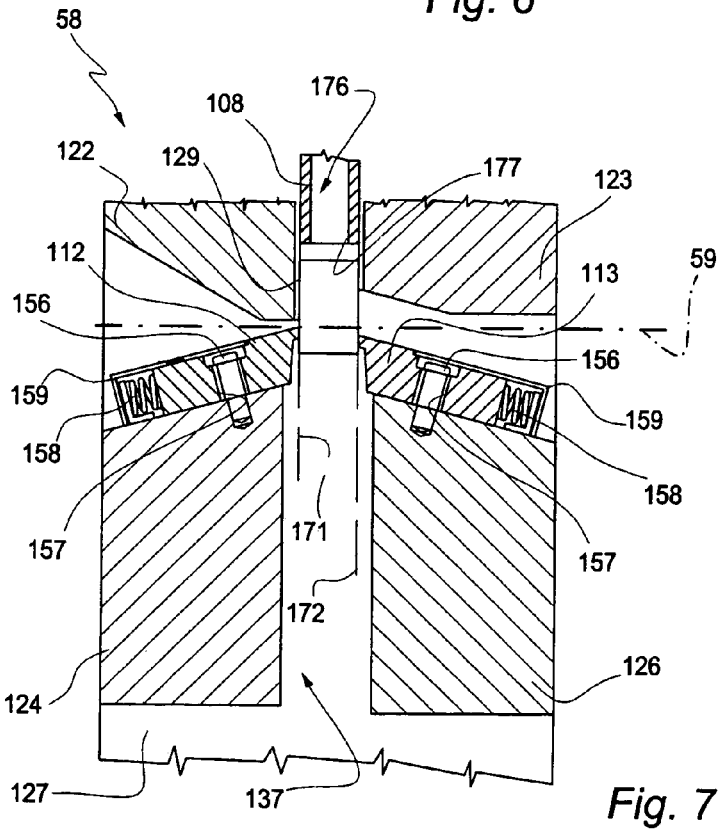
FIG. 7 is a schematic partial section, in enlarged scale, of the functional group of FIG. 2.

In the example of FIG. 7, the counter-blades 112 and 113 are slidably supported on the crossbars by means of pivots 156 and slots 157 and are constantly urged by a series of springs 158 against the guide stripes 129 and 131. Two covers 159 define a planar surface on the high portion of the counter-blades 112 and 113 for a free guide of the forms 37 and 42. Such structure ensures uniformity of cutting in the time, also avoiding the effects of thermal deformations due to the differences in the used materials.

The removability of the support module 107 allows an easy substitution of the cutting mechanism 58 with another one, minimizing the downtimes in case of resharpening of the cutting members and, in general, for the normal maintenance. The mechanism 58 can be easy substituted with a cutting mechanism of different features, as in the case of cutting strips 110 of different widths, or for cuts with blades having a single cutting edge.

The extraction device 60 (FIGS. 2 and 8) comprises a support module 161, a transport roller 162, pressure rollers 163 carried by an articulated frame 164, a motor 166 and a transmission assembly 167 with toothed pulleys and belt. The module 161 supports the transport roller 162 and the group formed by the rollers 163 and the frame 164. The motor 166 is supported by the side 51 of the frame 48 and is connected with the roller 162 by means of the pulleys and the belt of the transmission assembly 167.

The support module 161 is mounted with possibility of removal, for instance through screws, on the sides 49 and 51 of the frame 48. The transport roller 162 is tangent to the movement surface 59 and engages frictionally the form 37 or 42 emerging from the mechanism 58 to extract the cut sheet 38 at high speed according to a known technique. The removal of the support module 161 is very simple, being sufficient to remove the belt of the transmission assembly 167 and loosen the screws for the fixing of the support 161 to the frame 48.

For a reduction of the cutting times, the overall stroke of the blade 108, as determined by the eccentric cams 141 and 142, is selected for a very high value with respect to the stroke strictly necessary for the cutting of the form.

To this end, the cutting edges, represented with 171 and 172 (FIGS. 3, 9 and 10), are each one defined by two cutting edges 173*s* and 173*d* and 174*s* and 174*d*, respectively. The two sections converge symmetrically toward a middle portion 175 of the blade for a joined cutting with both the sides of the form 37 or 42 inclined between 0.5° and 1.5° with respect to the surface 59.

In a cutting mechanism of this type operating at high speed, the cut strips 110 can stick to the surface of the blade adjacent to the cutting edges with serious risks of jam.

According to another characteristic of the invention, the blade 108 in its body includes a series of passing ducts 176 enabling the passage of the air. These ducts end with a series of openings 177 along the surfaces 178*s* and 178*d* adjacent to the cutting edges 173*s* and 173*d* and 174*s* and 174*d*.

The ducts 176 directly connect the openings 177 of the surfaces 178*s* and 178*d* with the atmosphere and are substantially parallel to the direction of movement of the blade 108.

To advantage, the upper crossbar 121 of the support module 107 includes a series of passing holes 179, to minimize variations of pressure on the higher portions of the ducts 176. In alternative, it can be obtained by means of channels notched on the higher edges of the crossbars 122 and 123.

Several experimental tests have shown that the ducts 176 avoid that the strips 110 can stick to the surfaces 178*s* and 178*d*. Thus, the cut strips can freely fall in the underlying vane 137.

Probably, the problem of the adherence is overcome in view of the fact that the ducts 176 allow, on cutting, a continuous levelling of the pressure at the ambient value between the surfaces 178*s* and 178*d* of the blade and the strip 110. It prevents any Venturi effect which would squeeze the strip against the same surfaces 178*s* and 178*d*. Such solution is fully effective for a fraction of the areas of the openings 177 more than the 40% of the surfaces 178*s*, 178*d*.

For a blade 108 of given thickness "S1", for instance 7.8 mm, the ducts 176 are circular and can be obtained by drilling.

The axial ducts 176 are also effective for blades with a sole cutting edge and, also in this case, the ducts strongly reduce the adherence of the sheet cut to the surface of the blade adjacent to the cutting edge.

Figure 11:
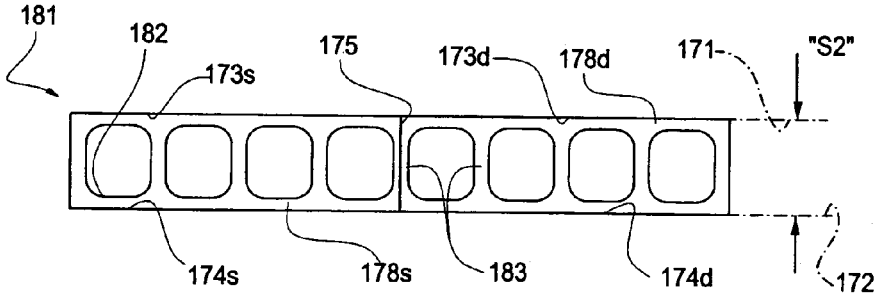
FIG. 11 shows a plan view of another form of execution of the component of FIG. 9.

In the case of blades 181 (FIG. 11) of large thickness "S2", for instance for the cut of strips of ½' or 1", the ducts 182, are obtained by electro-erosion in the body of the blade, forming connecting ribs 183 between the walls that define the cutting edges 171 and 172.

Figure 12:
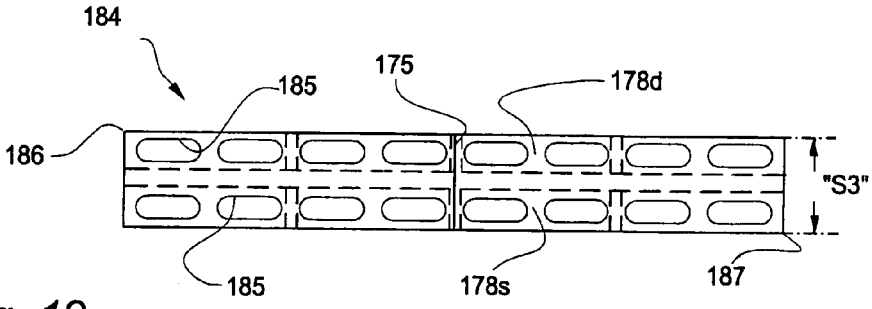
FIG. 12 represents a plan view of a further form of execution of the component of FIG. 9.

For blades 186 (FIG. 12) of thickness "S3" and with a twin-T structure, the ducts 187, have lengthened form and are obtained in the ribs 188 and 189 of the twin-T structure which define the surfaces 178*s* and 178*d*.

The support modules 107 with various types of blades, as a sole cutting edge or with more cutting edges and different features, can be identified by cutting codes, associated with the cutting specifications of the supported mechanism 58. The cutting codes of the mounted module 107 can be included in the basic program, or introduced by the user through the console 63, and the microprocessor 55 associates the data necessary for the correct operation of the equipment 34 to the set-up or read cutting code of the module.

According to another aspect of the invention, the equipment 34 can optionally include an automatic recognizing device 188 to recognize the typology of the installed mechanism 58.

By way of example, the cutting code can be physically defined in each support module 107 in a form recognizable by the device 188. The microprocessor 55 provides to reading the cutting code in a phase of initialization of the equipment and memorizing the information regarding the mounted mechanism 58. Upon the mounting of another support module 107, the new cutting code will be read and recognized to be used without any other intervention of the operator.

The cutting code of the module can be defined by a series of coding elements included in an insert member 189 and the recognizing device 188 can comprise a recognising block 190. The insert member 189 is fixed on the small sides 127 of the support module 107 and the recognising block 190 is fixed on the side 49 of the frame 48 to be in front of the insert 189 when the module 107 is correctly installed in the equipment 34.

The insert member 189 may include a coded series of metallic small bar and the block 190 has a correspondent series of proximity sensors arranged in predetermined codified positions. The state of the proximity sensors is conditioned by the presence of the small bar of the insert member 189, in front of the coded positions and the coded positions are readable, on control of the microprocessor 55, according to a technique note, for recogniting the cutting code of the module.

The code recognizing device 188 is insensitive to the stresses to which the support module 107 can be submitted during the maintenance or the storage in a workshop environment. As alternative, the cutting specifications can be included in electronic memories fixed on the support module 107 and automatically transferred, for instance through connectors, to the control and power system.

In a similar way, the trimming support module 99 can be identified by a trimming code indicative of the number and the features of the rotating disks present in the mechanism 57. The trimming code can be set-up through the console 63 or it can be defined by coding elements, recognizable by an automatic recognizing device, not shown in the drawings, similar to the device 188.

Figure 13:
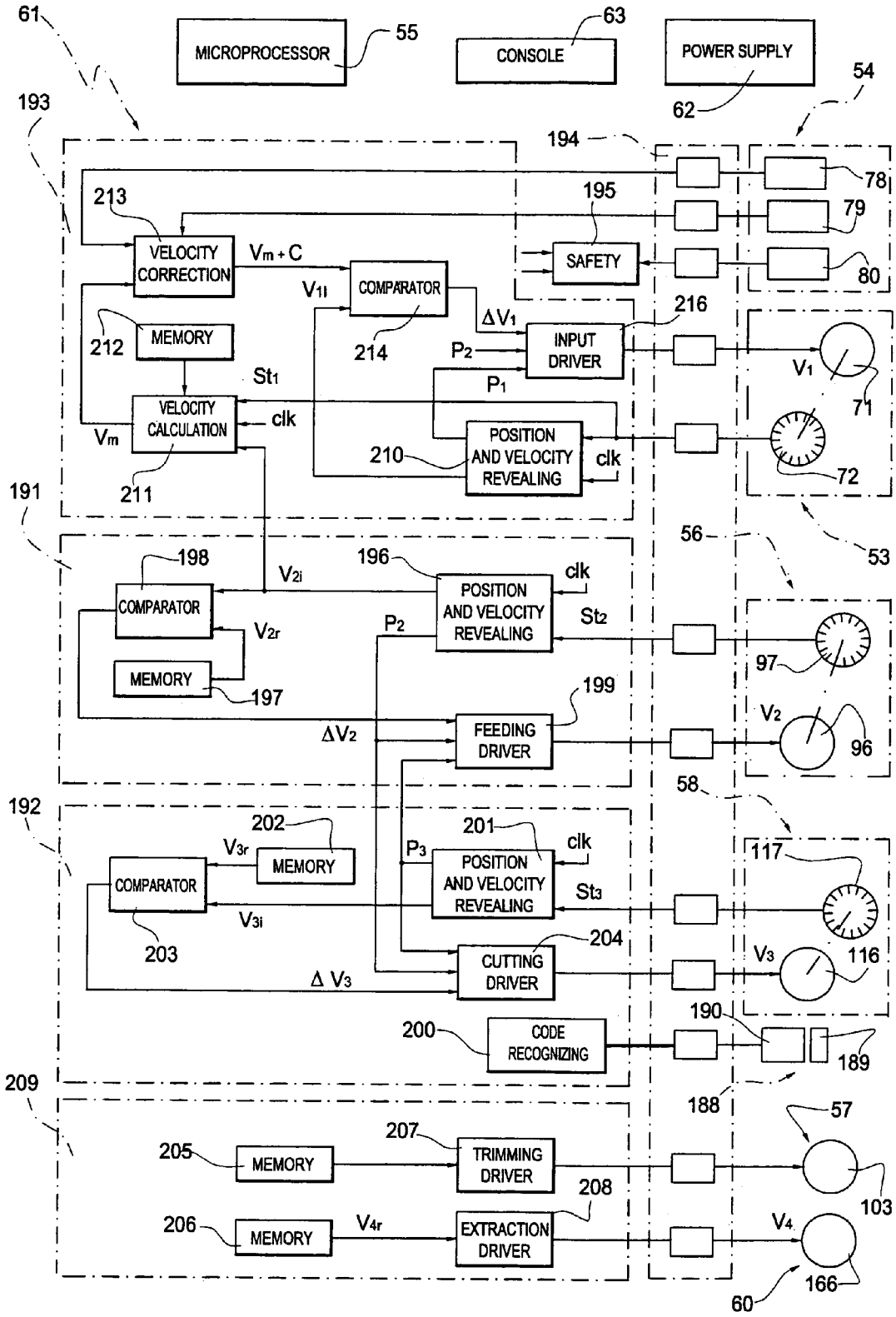
FIG. 13 represents a functional electric scheme of the cutting equipment according to the invention.

With reference to the FIG. 13, the electronic module 61 drives the actuating motor 96, of the cutting feeding device 56 on the basis of inputs from the console 63 and the program of the microprocessor 55 for advancing the sprocket belts of the tractors 91, 92 of an apparent value equal to the length of the sheet 38 to be cut. The electronic module 61 verifies this value through the encoder 92 and drives the input actuating motor 71 of the moving device 53 on control of the encoder 72 for an identical average advance of the sprocket belts of the tractors 66, 67 and the introduction of an identical length of form 37, 42 into the equipment 34.

The electronic module 61 responds to the pulses St2 of the encoder 97 to define the velocity V2 of the motor 96 on the basis of predetermined values, so as to stop the section of form 37 or 42 to be cut for the time strictly necessary to the cut, with strong accelerations and brakes achieved by the positive control of the tractors 91, 92.

The pulses St3 of the encoder 117 are also used to define the velocity V3 of the cutting actuating motor 116 and, together with the pulses St2, are used to start an actuation cycle of the blade 108 of the mechanism 58, while the section of form to be cut is still moving.

The positive control of the tractors 91, 92 allows an overlapping between the cycle of advancing of the form 37, 42 and the actuation cycle of the blade 108, with minimum delays between the time of stop of the section of form to be cut and the time in which the blade contacts the form and between the time in which the blade has completed the cut and the start of a new advancing of the form for a following cut.

Further, the electronic module 61 drives the input actuating motor 71 to introduce the form 37 or 42 at a mean velocity V1 depending on the mean velocity of the feeding actuating motor 96 and on the basis of information from the pulses St1 of the encoder 72 and from the photoelectric pairs 78 and 79. The drive is such to minimize the variation of the mean velocity V1.

Suitably, the power and control system further includes position sensors for aligning the form 37, 42 in the phase of initialization and safety devices, not shown in the drawings, for signalling breakages and jams of the form. A safety circuit 195 connected with the photoelectric pair 80 and to the other safety devices is also provided to recognize possible conditions of anomaly of the loop 82 and the other devices to arrest the equipment 34.

In detail, the electronic module 61 comprises functional groups 191, 192, 193 and 209 for controlling the feeding device 56, the cutting mechanism 58 and the code recognizing device 188, the input moving device 53 and, respectively, the group including the trimming mechanism 57 and the extraction device 60.

The electronic module 61 is timed by pulses "clk" of the power and control system and provides position information P1, P2 and P3 and velocity information V1*i*, V2*i* and V3*i* of the motors 71, 96 and 116 and the connected components in response to the pulses St1, St2 and St3, and on the basis of the program of the microprocessor 55.

An interface group 194 connects the functional groups 191, 192, 193 and 209 with the photoelectric pairs 78, 79 and 80, the position encoders 72, 97 and 117 and the recognizing device 188. The group 194 further includes input/output circuits and controls the actuating motors 71, 96, 116, 103 and 166 through power circuits known per sé.

The functional group 191 is pre-set to drive the feeding actuating motor 96 according to a law of motion optimized for a fast movement of the section of form 37, 42 to be cut on the basis of data of velocity to be set up by the user. According to a known technique, the group 191 provided phases of acceleration and braking predefined for the start and the stop of the motor 96 and intermediary phases at constant velocities depending on the length of the form to be cut and on the set data.

In synthesis, for the control of the motor 96 the group 191 includes, for example, a position and velocity sensing circuit 196, a portion of memory 197 with data of reference velocities, a comparing circuit 198 and a driving circuit 199.

The sensing circuit 196 recognizes the relative position P2 and the instant velocity V2*i* of the shaft of the motor 96 in response to the pulses "St2" and "clk" and, therefore, determine the position and the velocity of the section of form to be cut.

The portion of memory 197 stores the data of reference velocities V2*a* V2*b* for the acceleration and the brake of the feeding motor 96, data of the length of form to be cut set trough the console 63 and velocity values V2-1, V2-2, . . . V2-*n* associated with the set length. The circuit 198 compares the instant velocity V2*i* with the reference velocity V2*r* furnished by the portion of memory 197 and supplies a control signal ΔV2 for the circuit 199.

In response to the signal ΔV2 and on control of the position P3 of the mechanism 58 and the position P2, the driving circuit 199 actuates the feeding actuating motor 96. The starting point for the motor 96 is defined by a time "ts3" (see FIG. 15) representative of a final phase of the cutting cycle of the form 37 or 42 and its time of stop is defined by the advancing of the section of form corresponding to the set length.

The functional group 192 (FIG. 13) includes a position and velocity sensing circuit 201, a portion of memory 202 with data of position and reference velocity, a comparing circuit 203 and a driving circuit 204.

The group 209 includes a code recognition circuit 200 portions of memory 205 and 206 and driving circuits 207 and 208 for the motors 103 and 166. The portions of memory 205 and 206 store data regarding the trimming of the form 27, 42, and data of reference velocities for the motor 166 of the extraction device 60.

In the phase of initialization and in presence of the recognizing device 188, the microprocessor 55 recognizes the state of the sensors of the block 190 through the recognition circuit 200. Then it proceeds to identify the cutting code of the support module 99 and to load the portion of memory 202 with the data of the transversal cutting mechanism 58.

In absence of the device 188, the microprocessor 55 loads the portion of memory 202 with the data set through the console 63 or with the ones of the basic program.

The circuit 201 responds to the pulses "St3" and "clk" to generate the position data P3 and the velocity data V3*i* representative of the position and the instant velocity of the shaft of the cutting actuating motor 116 and, therefore, the position and velocity of the blade 108.

The portion of memory 202 stores the data of reference velocity V3*a* and V3*b* (see FIG. 15) for the acceleration and brake of the cutting actuating motor 116. The circuit 203 compares the instant velocity V3*i* of the motor 116 with the reference velocity V3*r* coming from the portion 202, and supplies a control signal ΔV3 for the circuit 204. In response to this signal and on control of the position data P2 and P3, the driving circuit 204 activates the motor 116 in correspondence of a time of intervention "ts2" (see FIG. 15) associated to a given position of the form and the blade and stops the motor 116 at the end of the cutting.

Jointly to the movement of the section of form to be cut, the driving circuit 207 actuates the motor 103 of the trimming mechanism 57 for the longitudinal cuts of the form 37, 42 on the basis of the mounted rotating disks and according to the data of trimming of the portion of memory 205.

The driving circuit 208 is controlled by the data of velocity V4*s* of the portion of memory 206 to drive the motor 166 of the extraction device 60 at a high velocity which results, for the form 37 or 42, greater than the velocity of the motor 96 for rapidly extracting the cut sheet 38.

Figure 14:
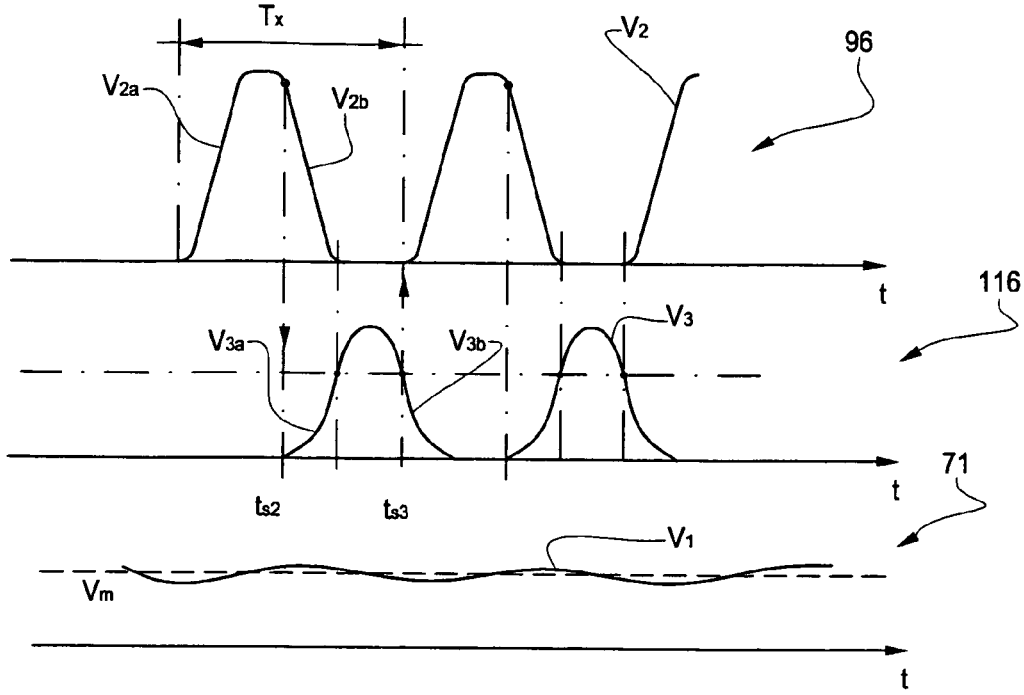
FIG. 14 shows an operational diagram of some components of the cutting equipment according to the invention.

In FIG. 14 are represented, as depending on the time, the diagrams of the velocities V1, V2 and V3 regarding the motors 71, 96 and 116 associated to the high speed cutting of a short sheet. Designated as Tx is the period between two sequential cycles of intermittent advancing of the form. The diagrams show the times of intervention ts2 for the start of the cutting cycle of the motor 116 and the times ts3 for the start of the intermittent feeding cycle of the motor 96.

Figure 15:
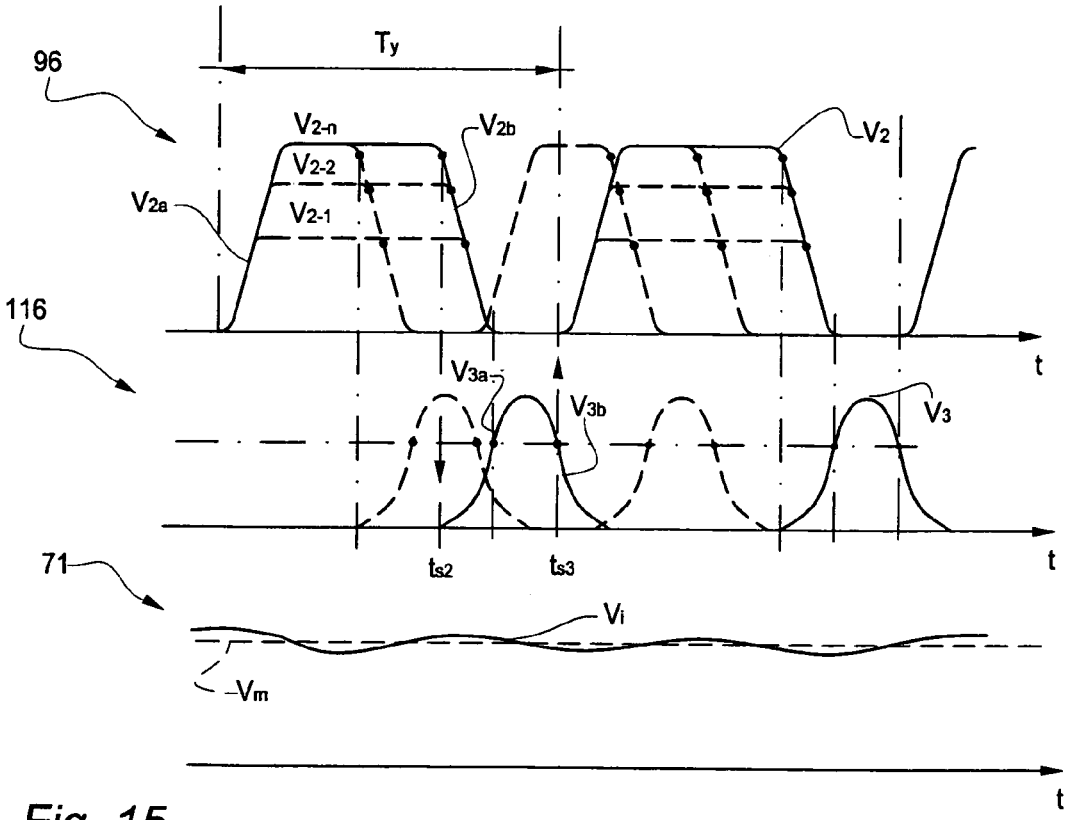
FIG. 15 is another operational diagram of the components of FIG. 14.

FIG. 15 represents, as depending on the time, the corresponding diagrams of the velocities V1, V2 and V3 for cuttings, at different velocities V2-1, V2-2 . . . and V2-*n*, sheets of different lengths, having periods Ty and times of intervention ts3 and ts2, different from the period Tx of FIG. 14.

The functional group 193 (FIG. 13) includes a position and velocity sensing circuit 210, a speed calculating circuit 211, a portion of memory 212 with data regarding the length of the sheet 38 to be cut, a speed correction circuit 213, a comparing circuit 214 and a driving circuit 216 for the input actuating motor 71.

The circuit 210 responds to the pulses St1 of the encoder 72 to recognize the position P1 and the instant velocity V1*i* of the shaft of the motor 71 and, therefore, of the entering form 37, 42.

The circuit 211 is connected to the sensing circuit 196 and responds to the pulses St1 of the encoder 72 and to information from the portion of memory 212 to calculate the mean velocity "Vm" which should assume the shaft of the motor 71 to maintain constant its velocity and stable the length of the loop section 82.

In synthesis, the value "Vm" is calculated on the basis of an algorithm in which the space equivalent to the length of the sheet 38 is divided by the time Tx, Ty between two consecutive congruent points of the cutting cycle. The equivalent space can be calculated as the number of pulses St1 of the encoder 72 equivalent to the set length of the sheet 38 stored in the portion of memory 212.

The speed correction circuit 213 calculates a corrective factor "C" on the basis of the state of the photoelectric pairs 78 and 79 and algebraically adds this factor to the value "Vm."

In steady state, the loop section 82 takes up more than the half of the vane 81, it obscures the receiver of the photoelectric pair 79, as minimum loop sensor, and the factor of correction "C" is calculated as fraction to be added or subtracted to the value "Vm" in dependence on the lighted or obscured state of the receiver of the photoelectric pair 78, as reference loop sensor.

In particular, if the photo receiver in the pair 78 is obscured, for a loop section 82 that overcomes the reference value, the corrective factor "C" is negative for causing a deceleration of the input actuating motor 71 with respect to the value "Vm". If, on the contrary, the receiver in the pair 78 is illuminated for a loop section 82 less of the reference value, the corrective factor "C" is positive for accelerating the motor 71.

The circuit 214 compares the instant velocity V1*i* with the correct velocity data Vm+C of the circuit 213 and supplies a signal of control ΔV1 to the circuit 216. By turns, the circuit 216 responds to the signal ΔV1 and is controlled by the position data Pi of the transversal cutting mechanism 58 and by the position data P2 to always maintain in motion the motor 71.

As it can be observed in the diagrams of the FIGS. 14 and 15 the velocity of the motor 71 is modulated in a very narrow range (around 10%) with respect to the mean velocity Vm of the form, whereby minimizing the tensions on the form 37 or 42 incoming in the equipment 34.

The circuit 213 also receives information from the photoelectric pair 79, as minimum loop sensor. If the loop section 82 is very short and enables the lighting of the receiver in the photoelectric pair 79, the circuit 213 generates a high factor of correction "C" for a high speed of the motor 71 and an express increase of the loop section 82.

In the phases of initialization, the microprocessor 55 provides to the advancing of the form 37, 42 at low velocity which is progressively increased up to reaching the steady state velocity.

The microprocessor 55 further controls the stop of the various components when the circuit 195 recognizes the obscuring in the photoelectric pair 80, indicative of the condition of anomalous maximum loop or recognizes other anomalies signaled by the safety devices.

The control by the groups 192 and 193 assures a high stability and very limited variations in the dimensions to the loop section 82. It allows the equipment 34 to operate with sections of loop of reduced length and to simplify the formation of the loop and the introduction of the form 37, 42.

Figure 16:
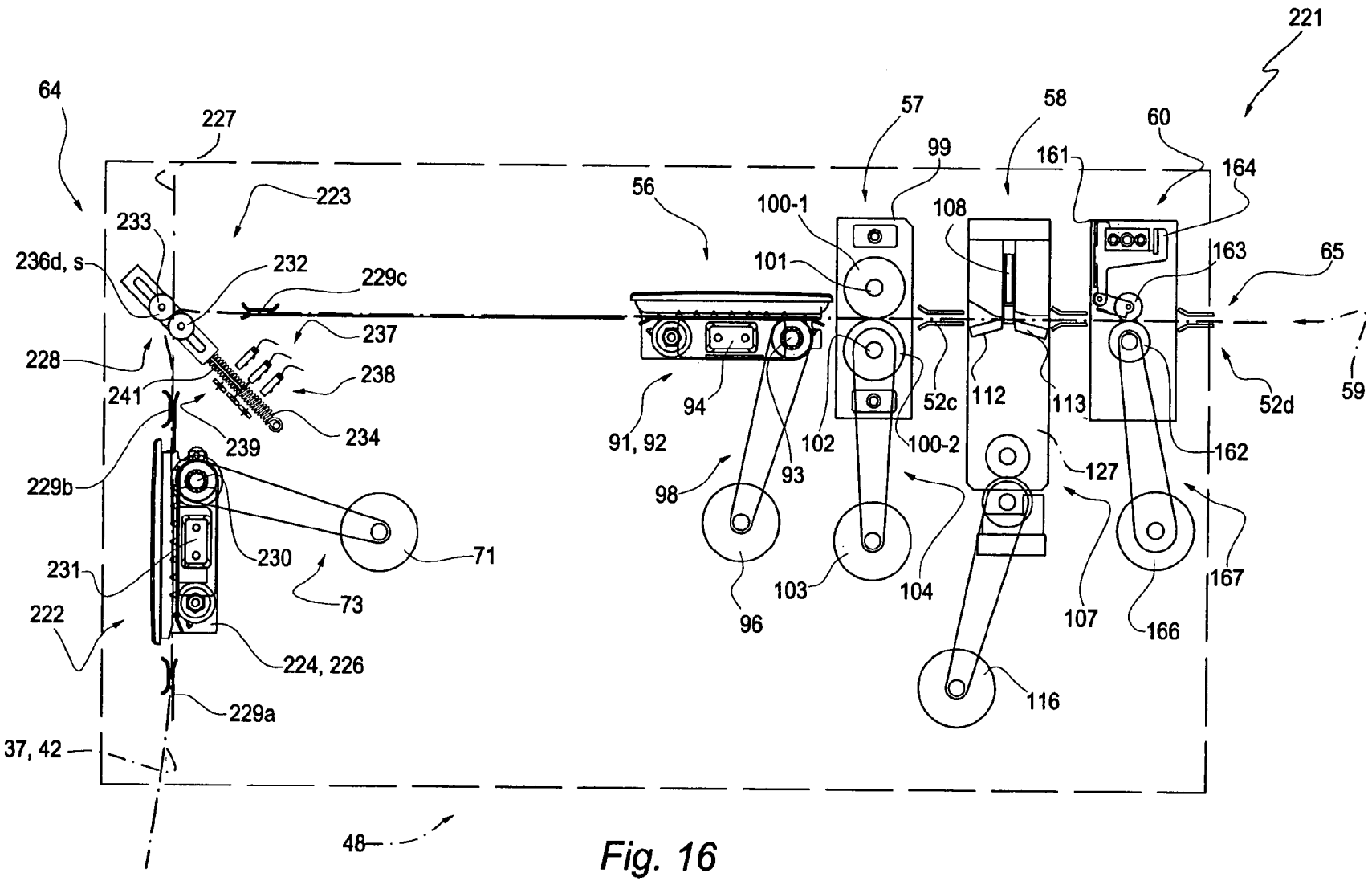
FIG. 16 represents the cutting equipment of FIG. 2 with variants to some components.

FIG. 16 shows a cutting equipment, represented with 221, that provides a web loop of high stability. The input moving device and the loop forming device are modified with respect to the ones of the equipment 34 and are represented with 222 and 223, while the components not modified maintain the same numeration of the equipment 34.

The moving device 222 has the same function of the device 53. The differences concern the fact that the input tractors 224 and 226, identical to the tractors 66, 67, are vertically arranged in the input area 64 so as to define for the form 37, 42 an input movement surface 227 perpendicular to the movement surface 59.

The device 223 has a structure such to define, in the input area 64, a loop section 228 with extends upwardly inclined back at 45° with respect to the input movement surface 227.

Support and guide elements 229*a* and 229*b* are provided upstream and downstream from the tractors 224 and 226 to support and guide the continuous form 37, 42, and a support and guide element 229*c* is arranged between the device 223 and the intermediate tractors 91, 92.

In the moving device 222, the tractors 224 and 226 are connected in the rotation by a motor axis 230 and are mounted on a guide and support axis 231, both mounted between the sides 49 and 51 of the frame 48. The motor 71 is adapted to put in rotation the motor axis 230 through the pulleys and the belt of the transmission assembly 73, for a relative movement of the sprocket belt along the input movement surface 227.

The loop forming device 223 includes a pushing roller 232, a contrast roller 233 and a pair of coil springs 234.

The rollers 232 and 233 extend for the whole width of the form 37 or 42 and their axes can slide in respective guides 236*s* and 236*d* interposed between the sides 49 and 51, inclined about 45° with respect to the input movement surface 227. The springs 234 push upwardly the roller 232, forming the loop section 228 on the entering form 37, 42 between the guide elements 229*b* and 229*c* and maintaining the loop section taut under dynamic conditions.

Two photoelectric pairs 237 and 238 similar to the pairs 78 and 81 are associated to the device 223 for revealing the reference condition of the loop section 228 and a condition of minimum loop. A further photoelectric pair 239 similar to the pair 80 is further provided to recognize the condition of anomalous maximum loop. For the control of the loop is provided a shovel member 241, with function of shutter, synchronous in the movement with the rollers 232 and 233.

The photoelectric pairs 237, 238 and 239 can include, each one, a LED emitter and a photoelectric receiver. The elements of the pairs are arranged by opposite parts and at different heights in the direction of movement of the shovel member 241 and the relative photoelectric receiver is darkened in response to the fluctuations of the loop section 228.

The photoelectric pair 237 is arranged at an intermediate position with respect to the shovel member 241 to recognize positions of the roller 232 associated to a reference value of the loop section 279. The photoelectric pair 238 and 239 are arranged in a lower position and, respectively, in an upper position with respect to the pair 237 to recognize loops of length less than a minimum value and, respectively, loops of length more than a maximum value.

In the embodiment of FIG. 16 the trajectory of the form 37, 42 extends in spaces easily accessible by the user. The introduction of the form and its engagement by the input tractors 224 and 226, the rollers 232 and 233 and the tractors 91, 92 result therefore very simplified.

In alternative to the reciprocating blade 108, the cutting mechanism may include a blade and a counter-blade supported by respective drums counter rotating in synchronism each the other and asynchronously with respect of the form to be cut. A cutting servomechanism controls the rotations of the drum for the cutting action of the blade and counter-blade in the desired position.

The blade and the counter-blade can be arranged either at fixed angular positions of the drums or along helicoidal pattern. In the first case the cutting feeding mechanism stops the form during the cutting and the cut occurs simultaneous along the transversal line. In the second case, the cutting proceeds from a side to the other of the form and the feeding mechanism provides a cutting velocity of the form adapted to the rotational speed of the rotary and such to advance the form during the cut through a value corresponding to the pitch of the blade and counterblade. Thus, a cutting edge extending perpendicularly to the conveying direction of the form is established.

Naturally, the embodiments and the details of construction may be varied with respect to what has been described and illustrated purely by way of non-restrictive example, without departing from the scope of this invention.

We claim:

1. A cutting equipment for continuous forms including a frame; an input moving device and an input servomechanism for the entering form; a loop forming device with a loop accommodating structure; a cutting feeding device and a feeding servomechanism for the section of form to be cut; a transversal cutting mechanism having a cutting tool and a cutting servomechanism for moving the cutting tool; and memory means for storing length data relating to a length of a section of the form to be cut and velocity data relating to velocity values of said section of the form, said frame supporting the input moving device, the loop forming device, the cutting feeding device and the transversal cutting mechanism, and said loop accommodating structure being arranged between the input moving device and the feeding device to receive a loop section downwardly to said input moving device, and wherein said feeding device defines a feeding cycle having a motion period and a stopping period for the section of form to be cut, while the cutting of said section of form occurs during said stopping period, said equipment further comprising:

an input motor for advancing the entering form and an input position encoder for said input moving device, said input position encoder supplying input signals associated to advancing steps of the entering form;

an input sensing circuit, and input driver circuit means for said input servomechanism, said input sensing circuit responding to said input signals for generating input velocity signals associated to the instantaneous velocity of the entering form;

at least a loop sensor of said loop forming device for revealing a reference value of said loop section on said accommodating structure and supplying a reference loop signal indicative of a length greater than said reference value;

a cutting position encoder for said cutting servomechanism supplying cutting signals associated to position steps of the cutting tool;

a feeding motor for advancing the form to be cut and an intermediate position encoder for said cutting feeding device, said intermediate position encoder supplying feeding signals associated to advancing steps of the form to be cut; and a reference velocity generating circuit, a feed sensing circuit and feed driver circuit means for said feeding servomechanism, said reference velocity generating circuit responding to the velocity data of said memory means for generating reference feed velocity signals associated to a given cutting law of movement of the section of form to be cut, and said feed sensing circuit responding to said feeding signals for generating instantaneous feed velocity signals associated to the instantaneous velocities of said form to be cut, and wherein said feed driver circuit means responds to the reference feed velocity signals, the instantaneous feed velocity signals and said cutting signals for moving the section of form to be cut according to said given cutting law of movement;

wherein said input servomechanism further includes a calculating circuit and a correcting circuit, in order to cause said continuous form to be entered with an input velocity having reduced modulations around an average value, wherein said calculating circuit is connected to said memory means and—responds to said feed velocity signals and said input signals for calculating a mean velocity signal as function of the stored length data, the instantaneous velocity of the form to be cut and the time interval of said feeding cycle, while said correcting circuit is provided for supplying a corrected mean velocity signal in response to said mean velocity signal and said reference loop signal; and wherein said input driver circuit means drives said input motor in response to said input velocity signals and said corrected mean velocity signal;

said corrected mean velocity signal corresponding to said mean value increased by a corrective factor represented by a given fraction of said mean value for the reference loop signal indicative of a loop greater than said reference value, and to said mean value decreased by said corrective factor for the loop signal indicative of a loop not greater than said reference value.

2. The cutting equipment according to claim 1, wherein said form has side sprocket holes an said input moving device includes pin feed tractors actuated by said input motor for cooperating with the sprocket holes of the entering form, and wherein said cutting feeding device includes intermediate pin feed tractors actuated by said feeding motor for cooperating with the sprocket holes of the form adjacent to the cutting mechanism.

3. The cutting equipment according to claim 1, wherein said input driver circuit means includes a comparator circuit comparing said input velocity signals and said corrected mean velocity signal.

4. The cutting equipment according to claim 1, further comprising a minimum loop sensor of said sensing device for revealing loop sections of length less than a minimum value and supplying a corresponding minimum loop signal indicative of a length less than said minimum value, and wherein said correcting circuit responds to said minimum loop signal to cause said corrective factor to further increase said input velocity.

5. The cutting equipment according to claim 1, further comprising a maximum loop sensor of said sensing device for revealing, as conditions of anomaly, loop sections of length more than an acceptable maximum value.

6. The cutting equipment according to claim 1, wherein said loop forming device further comprises a paper guide member and wherein said loop accommodating structure has an U shaped section forming a vane for said loop section, said vane being adjacent to said input moving device and said paper guide member having first portions for holding the form adjacent to the input moving device and a second portion arranged internally to said vane.

7. The cutting equipment according to claim 1, wherein said loop accommodating structure includes a laminar structure of U shaped section forming a vane for said loop section, said laminar structure being vertically mounted on the frame and having an input edge adjacent to said input moving device and an output edge adjacent to an element of support for the section of form to be cut.

8. A cutting equipment for continuous forms comprising an input moving device for a continuous paper form, a cutting feeding device, a transversal cutting mechanism for the form, and a frame supporting the input moving device, the cutting feeding device and the transversal cutting mechanism, wherein said form has side sprocket holes and said input moving device includes input pin feed tractors for cooperating with the sprocket holes of the entering form and an input position encoder connected to said input tractors, said input position encoder supplying input signals associated to advancing steps of the entering form, and wherein said cutting feeding device includes intermediate pin feed tractors for cooperating with sprocket holes of the form adjacent to the cutting mechanism, an intermediate position encoder for supplying feeding signals associated to advancing steps of the form to be cut, and feed circuit means for controlling said pin feed tractors, wherein said feed circuit means responds to stored velocity data for a section of form to be cut and includes a feed sensing circuit responding to said feeding signals for generating feed velocity signals associated to the instantaneous velocity of the form to be cut and;

said feeding device defining a feeding cycle having a motion phase and a stopping phase for the section of form to be cut and wherein the cutting of said section of form occurs during said stopping phase, said equipment further comprising:

a loop device for defining a loop section of the entering form including a loop accommodating structure supported by said frame adjacent to said input tractors for accommodating said loop section, and at least a reference loop sensor for revealing a reference value of said loop section and supplying a corresponding loop signal; and input circuit means for controlling said input pin feed tractors, said input circuit means including an input sensing circuit responding to said input signals for generating an input velocity signal associated to the instantaneous velocity of the entering form;

wherein said motion phase of said feeding cycle includes an acceleration phase, a phase of constant velocity advancing and a deceleration phase for said section of form, and wherein said input circuit means includes a velocity calculation circuit and a velocity correction circuit, said velocity calculation circuit responding to said feed velocity signal for generating a mean velocity signal corresponding to an average value of the velocity of the section of form to be cut in the time interval of said feeding cycle, and said velocity correction circuit responding to said reference loop signal and to said mean velocity signal for generating a corrected mean velocity signal; and wherein said input circuit means drives said input moving device according to said input velocity signal and said corrected mean velocity signal in order to cause said continuous form to be entered with an input velocity having reduced modulations around an average value;

said corrected mean velocity signal corresponding to said mean value increased by a given fraction for the reference loop signal indicative of a loop section greater than said reference value, and to said mean value decreased by said given fraction for the reference loop signal indicative of a loop section not greater than said reference value.

9. The cutting equipment according to claim 8, further comprising a maximum loop sensor of said loop forming device for revealing, as conditions of anomaly, loops of length more than an acceptable maximum value.

10. The cutting equipment according to claim 8, wherein said loop accommodating structure has an U shaped section forming a vane for said loop and arranged adjacent to said input tractors and further comprising a paper guide member having first portions for holding the form adjacent to the input tractors and a second portion arranged inside said vane.

11. A cutting equipment for continuous forms including a frame, an input moving device and an input servomechanism for the entering form, a loop forming device, a cutting feeding device and a feeding servomechanism for the form to be cut, a transversal cutting mechanism having a cutting tool; and memory means for storing length data relating to a length of a section of the form to be cut and velocity data relating to velocity values of said section of the form, said frame supporting the input moving device, the loop forming device, the cutting feeding device and the transversal cutting mechanism, said loop forming device being arranged between the input moving device and the feeding device, and wherein said feeding device defines a feeding cycle having a motion period and a stopping period for the section of form to be cut, while the cutting of said section of form occurs during said stopping period, said equipment further comprising:

an input sensing circuit for said input servomechanism and an input position encoder for supplying input signals associated to advancing steps of the entering form;

a reference a loop sensor of said loop forming device for revealing a reference value of said loop and supplying a corresponding reference loop signal indicative of a length more than said reference value;

a minimum loop sensor for revealing loops of length less than a minimum value and supplying a corresponding minimum loop signal indicative of a length less than said minimum value; and a feeding servomechanism of said cutting feeding device including an intermediate position encoder for supplying feeding signals associated to advancing steps of the form to be cut, and a feed sensing circuit responsive to said feeding signals for generating an instantaneous velocity signal associated to the instantaneous velocity of said form to be cut;

said feeding servomechanism being designated for moving the section of form to be cut according to a given cutting law of movement depending on the stored velocity data and servoized to the instantaneous velocity signal of said feed sensing circuit;

wherein said input circuit means includes a calculating circuit and a correcting circuit, said calculating circuit being connected to said memory means, said feed sensing circuit and said input position encoder and being provided for calculating a mean velocity signal as function of the stored length data, the velocity of the form to be cut and the time interval of said feeding cycle, while said correcting circuit being provided for supplying a corrected mean velocity signal in response to said mean velocity signal, said reference loop signal and said minimum loop signal; and wherein said input servomechanism is servoized to said corrected mean velocity signal and to said input position encoder in order to cause said continuous form to be entered with an input velocity having reduced modulations around an average value;

said corrected mean velocity signal corresponding to said mean value increased by a corrective factor represented by a given fraction of said mean value for the reference loop signal indicative of a loop greater than said reference value, and to said mean value decreased by said corrective factor for the reference loop signal indicative of a loop not greater than said reference value; and said corrective factor being directed to further increase said input velocity if said correcting circuit receives said minimum loop signal indicative of a loop less than said minimum value.

12. The cutting equipment according to claim 11, further comprising a maximum loop sensor of said loop forming device for revealing, as conditions of anomaly, loops of length more than an acceptable maximum value.

* * * * *